US005489046A

United States Patent [19]

Wickham

[11] Patent Number: 5,489,046

[45] Date of Patent: Feb. 6, 1996

[54] SQUEEZABLE DISPENSER WITH A RECESSED BOTTOM SPOUT

[76] Inventor: Sandy J. Wickham, P.O. Box 850, Pagosa Springs, Colo. 81147

[21] Appl. No.: 847,870

[22] Filed: Mar. 9, 1992

Related U.S. Application Data

[63] Continuation of Ser. No. 584,094, Sep. 18, 1990, abandoned.

[51] Int. Cl.[6] ..... B67D 5/06

[52] U.S. Cl. ..... 222/184; 222/212; 222/534

[58] Field of Search ..... 222/184, 185, 222/212, 215, 287, 482, 528, 534

[56] References Cited

U.S. PATENT DOCUMENTS

| | | | |
|---|---|---|---|
| 1,960,102 | 5/1934 | Faux | 222/184 |
| 2,750,085 | 6/1956 | Bode et al. | 222/528 |
| 2,800,259 | 7/1957 | Wilson et al. | 222/534 |
| 2,894,666 | 7/1959 | Campbell | 222/528 |
| 3,057,525 | 10/1962 | Malachick | 222/482 |
| 3,162,331 | 12/1964 | Hutchins et al. | 222/184 |
| 3,171,573 | 3/1965 | Berney | 222/534 X |
| 3,255,927 | 6/1966 | Ruppert et al. | 222/185 |
| 3,568,891 | 3/1971 | Parish | 222/213 |
| 3,837,533 | 9/1974 | Splan | 222/185 |
| 3,923,211 | 12/1975 | Spreen | 222/528 |
| 3,926,347 | 12/1975 | Low et al. | 222/185 |
| 4,098,434 | 7/1978 | Uhlig | 222/94 |
| 4,146,156 | 3/1979 | Cassia | 222/181 |
| 4,258,865 | 3/1981 | Vahl et al. | 222/213 |
| 4,314,658 | 2/1982 | Laauwe | 222/213 |
| 4,324,349 | 4/1982 | Kaufman | 222/207 |
| 4,506,809 | 3/1985 | Corsette | 222/213 |
| 4,535,918 | 8/1985 | Heiligman et al. | 222/185 |
| 4,883,198 | 11/1989 | Manska | 222/481 |
| 4,928,860 | 5/1990 | Knight | 222/184 |

*Primary Examiner*—Gregory L. Huson
*Attorney, Agent, or Firm*—Banner & Allgretti, Ltd.

[57] ABSTRACT

A dispenser made of a soft plastic material suitable for squeeze-type dispensing of liquid. A plastic lid screws onto threads at the bottom of the container and a flip down recessed spout is attached to the screw-on lid. A dead space filled with air or solid plastic material is integrally formed in the container and serves as a shouldered, internal floor for the container to facilitate flow of the contents of the container toward the spout. The external profile of the dead space also allows a plurality of containers to be packaged easily together in a very compact space. The screw on lid is located between the dead space portions at the bottom of the container.

10 Claims, 2 Drawing Sheets

SQUEEZABLE DISPENSER WITH A RECESSED BOTTOM SPOUT

This application is a continuation of application Ser. No. 07/584,094, filed Sep. 18, 1990, now abandoned.

BACKGROUND OF THE INVENTION

The present invention relates generally to the field of liquid containers, and more specifically, is directed to a squeezable type dispenser for dispensing fluid, such as liquids and low viscosity material.

The prior art recognizes the need for a squeezable type container for such household products as hair shampoo, liquid soaps and certain foods. One such container is described in U.S. Pat. No. 4,314,658 issued in the name of Laauwe and U.S. Pat. No. 4,324,349 issued in the name of Kaufman.

The Laauwe patent discloses a squeezable bottle which has a mouth provided with a dispensing valve. The valve is elastically biased in a normally closed position and is forced open by the pressure of the product as the bottle is being squeezed and partially collapsed. After the required amount of product has been dispensed, the bottle is returned to its uncollapsed condition by allowing air to be vented back into the bottle through one or more permanently open passageways formed in the valve. The passageways are sufficiently small so that air can pass through but not the relatively viscous product being dispensed from the bottle.

The Kaufman patent also discloses a squeezable bottle type dispenser. In the Kaufman dispenser, the liquid to be dispensed is forced through an air pocket and down an outlet passageway as the bottle is squeezed. When the bottle is released, air is drawn back through the outlet passageway in order to restore the air pocket and to clear any residual liquid from the outlet passageway.

While the above prior art squeezable bottles represent an improvement over prior designs, they remain deficient in a number of areas. For example, the Laauwe bottle is not practical for a totally inverted product container position and requires a great deal of experimentation in order to determine the correct cross-sectional area of the air passageway for venting air into the bottle while at the same time keeping product form escaping through the passageway. Moreover, such a bottle has limited utility as the passageway must be designed for each specific product having a different viscosity. The Kaufman bottle requires a mounting support in order to hold the bottle in an inverted position during the dispensing operation. Thus, the Kaufman approach is cumbersome and also expensive.

SUMMARY OF THE INVENTION

Thus, it is an overall object of the present invention to provide a squeezable bottle for dispensing liquids which overcomes the above noted disadvantages of prior art squeezable bottles.

It is a specific object of the present invention to provide a squeezable bottle for dispensing liquids which is easy to manufacture and is low in cost.

It is another specific object of the present invention to provide a squeezable bottle for dispensing liquids which is compact in construction and can be held easily during use.

It is a further specific object of the present invention to provide a squeezable bottle for dispensing liquids which is reliable in operation and is not prone to leakage during use.

It is a still further specific object of the present invention to provide a squeezable bottle for dispensing liquids which can be sealed and re-sealed in order to permit multiple usages.

It is another specific object of the present invention to provide a squeezable bottle for dispensing liquids which can be packed easily together with a plurality of other such bottles in a compact manner.

The above and other objects of the present invention are achieved by a soft plastic container suitable for squeeze-type dispensing of liquids. A plastic lid screws onto threads at the bottom of the container. A flip down, recessed spout is attached to the screw-on lid. A dead space filled with air or solid plastic material is integrally formed in the container and serves as a shouldered, internal floor for the container to facilitate flow of the contents of the container toward the spout. The external profile of the dead space also allows a plurality of containers to be packaged easily together in a very compact space. The screw on lid is located between the dead space portions at the bottom of the container.

The present invention will be better understood from the following description in connection with the attached drawings in which:

DETAILED DESCRIPTION OF THE PREFERRED EMBODIMENT

Figure 1:
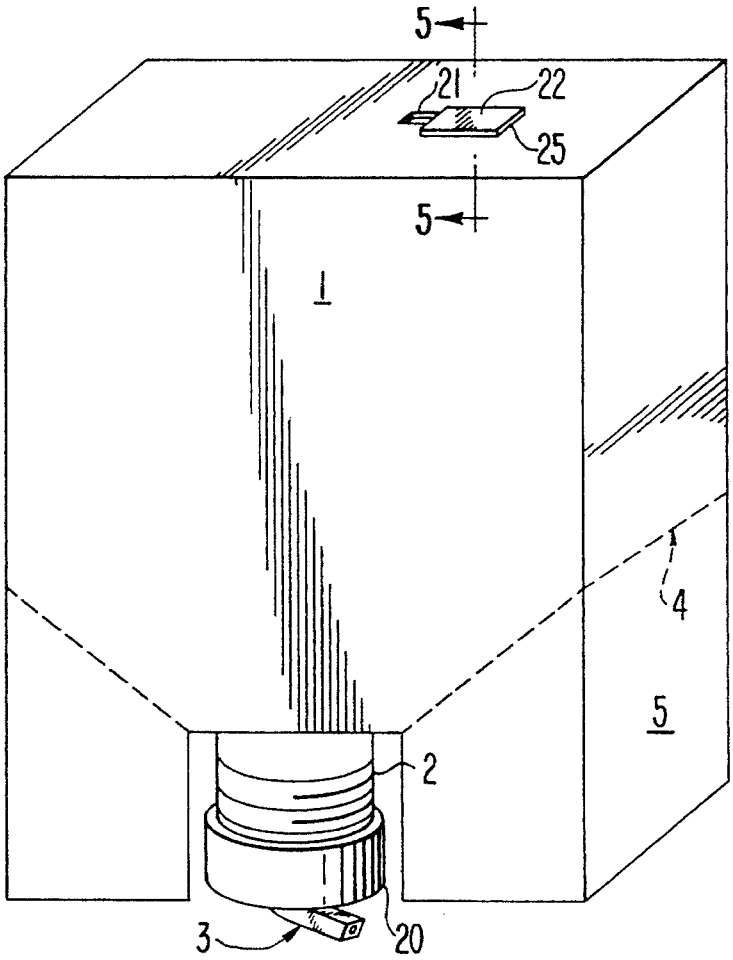
FIG. 1 is a front perspective view of a squeezable bottle in accordance with Applicant's invention.

FIG. 1 illustrates the overall construction of the liquid dispenser in accordance with Applicant's invention. The invention is formed of a liquid-proof chamber 1 which may be constructed of a soft pliable plastic material. A threaded neck portion 2 is formed at the lower end of chamber 1 and receives screw cap 20. Cap 20 includes flip-up spout 3 through which liquid can be withdrawn from the container. The lower internal walls of chamber 1 are formed on an incline or slope 4 so that when the container is inverted, the liquid in the container automatically flows toward screw cap 20 and spout 3.

Chamber 1 also includes dead space 5 which at least partially surrounds screw cap 2. Dead space 5 helps to form the lower walls of chamber 1 as indicated by the dotted lines in FIG. 1. These spaces also provide symmetry to the outer profile of chamber 1 such that the container is easy to hold and to package with other similar containers i.e., dead space 5 provides external support for chamber 1 when the container is resting as shown in FIG. 1.

Figure 2:
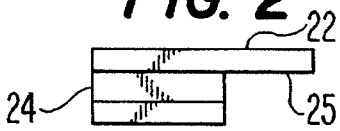
FIG. 2 is a side view of one embodiment of a cover for the squeezable bottle vent hole.

As also shown in FIG. 1, screw cap 20 and spout 3 are located between dead spaces 5 which serve also to protect these elements from inadvertent damage. FIG. 1 also illustrates vent hole 21 and slide cover 22. Vent hole 21 permits air to be drawn in to chamber 1 after the dispensing operation in order for the chamber to be returned to its original size and shape after being squeezed to dispense the product. The vent hole may be formed at the same time as chamber 1 is formed. Slide cover 22 is formed as a separate piece and has a groove portion 24 along it side edges and an overhang portion 25 as shown in FIG. 2. Grooves 24 engage the inside edge of vent hole 21 and allow the cover to slide over and cover the vent hole. Overhang portion 25 covers the right hand end of the vent hole when the cover is moved to its left most position over the hole in order to seal off the hole.

Figure 5:
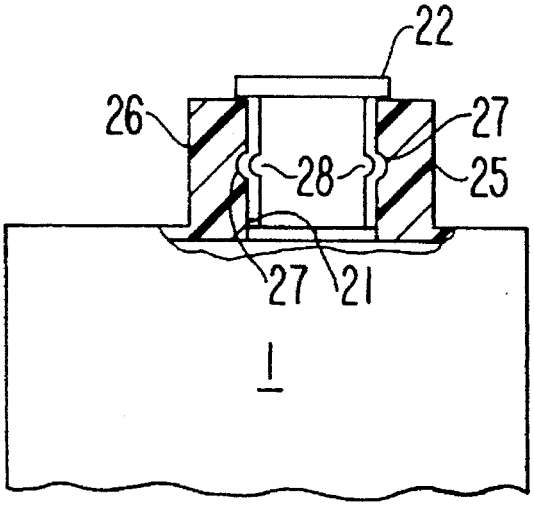
FIG. 5 is a cross-sectional view taken along lines 5—5 in FIG. 1.

Slide cover 22 also may be designed to ride along a pair of raised rails or ribs formed along the top surface of chamber 1 adjacent hole 21. A cross-section of this embodiment is illustrated in FIG. 5 and includes side rails 25 and 26. A groove portion 27 is formed into each of the side rails into which ribs 28 formed on slide cover 22 are engaged as illustrated in FIG. 5. Side rails 25 and 26 also may be formed at the same time as chamber 1 is formed.

Figure 3:
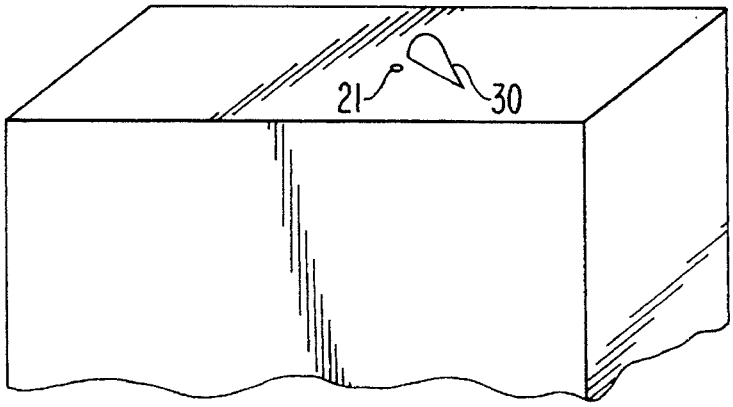
FIG. 3 is a top perspective view of a squeezable bottle in accordance with Applicant's invention illustrating another embodiment of a cover for the air vent hole.
Figure 4:
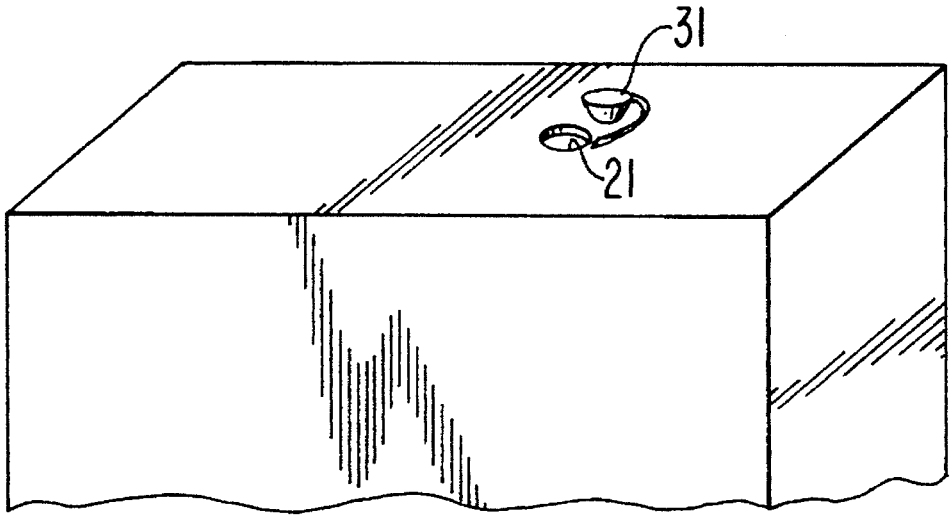
FIG. 4 is a top perspective view of a squeezable bottle in accordance with Applicant's invention illustrating a further embodiment of a cover for the air vent hole.

As shown in FIG. 1, chamber 1 is formed in a rectangular shape with square corners. Other shapes also are suitable, including a rectangular or square shape with rounded corners and a circular shape. FIGS. 3 and 4 also illustrate other various embodiments of vent hole 21 and a corresponding cover. In the embodiment illustrated in FIG. 3, hole 21 is covered by a recloseable peel-back piece of foil 30. In order to insure an air seal, contact adhesive may be applied to the area around hole 21 and/or the area around the edge of foil 30. Thus, when foil 30 is pressed in place to cover hole 21, the adhesive forms an air tight seal for hole 21. In the embodiment illustrated in FIG. 4, hole 21 is covered by a plastic cap or plug 31 which can be hingeably attached to chamber 1 and may be formed at the same time as chamber 1 is formed.

Vent hole 21 may not be necessary for all products but does serve to increase the desirable air pressure in the empty space above the product as the product is used and the product level decreases. In cases where no air vent hole is provided, screw cap 20 and spout 3 serve as an inlet for air after the dispensing operation. The inflow of air provides an efficient means for cleaning product from the cap and spout.

While the present invention has been illustrated and described in detail in the drawings and foregoing description, it will be recognized that changes and modifications can and will occur to those skilled in the art. It is therefore intended by the appending claims, to cover any such changes and modifications as fall within the true spirit and scope of the invention.

I claim:

1. A pliable material forming a container for dispensing liquid said container comprising:

a chamber for holding said liquid;

nozzle means attached to said chamber and adapted for dispensing said liquid from said chamber in response to a compressing force applied to said chamber, said nozzle means projecting away from said chamber and including a retractable spout forming a valve through which liquid is dispensed, said valve being closed when said spout is retracted and being open when said spout is extended;

said chamber further including support means having a pair of opposed surfaces, one of said surfaces providing stability to said chamber when said chamber is standing on said support means, the other of said opposed surfaces forming a wall of said chamber said support means surrounding at least a portion of said nozzle means so that said nozzle means is within a profile of said container formed by said chamber and said support means; and vent means, located in said chamber for permitting air to be drawn into said chamber after liquid has been dispensed.

2. The container according to claim 1, wherein said vent means is manually operated.

3. The container according to claim 1, wherein said vent means comprises an aperture in the chamber and a peel-back resealable cover covering the aperture.

4. The container according to claim 1, wherein said vent means includes an aperture in the chamber and a removable plug disposed within the aperture.

5. A container for dispensing liquid comprising:

a pliable material forming a chamber having a side wall, a tapered wall, a top end, and a bottom end, said side wall having a first end and a second end and extending parallel to a longitudinal axis of said chamber, said top end being connected to said first end of said side wall, said tapered wall having a first end and a second end, said first end of said tapered wall being connected to said second end of said side wall, and said second end of said tapered wall being connected to said bottom end;

nozzle means for dispensing liquid from said chamber when a compressing force is applied to said chamber, said nozzle means having a longitudinal axis and being connected to said bottom end of said chamber and projecting away from said bottom end of said chamber so said longitudinal axis of said nozzle means is parallel to said longitudinal axis of said chamber, said nozzle means including a retractable spout forming a valve through which liquid is dispensed, said valve being closed when said spout is retracted and being open when said spout is extended;

said chamber further including support means, connected to said first end of said tapered wall and projecting away from said top end of said chamber parallel to said longitudinal axis of said chamber for providing a planar surface for stability to said chamber when said chamber is standing on said bottom end, said support means surrounding at least a portion of said nozzle means so that said nozzle means is within a profile of said container formed by said chamber and said support means, wherein said planar surface is opposed to a wall of said chamber; and vent means, located in said top side of said chamber, for permitting air to be drawn into said chamber after liquid has been dispensed.

6. The container according to claim 5, wherein the vent means is manually operated.

7. The container according to claim 5, wherein the vent means comprises an aperture in the chamber and a peel-back resealable cover covering the aperture.

8. A container for dispensing liquid comprising:

a pliable material forming a chamber having a side wall, a tapered wall, a top end, and a bottom end, said side walls having a first end and a second end and extending parallel with a lateral axis of said chamber, said top end being connected to said first end of said side wall, said tapered wall having a first end and a second end, said first end of said tapered wall being connected to said second end of said side wall, and said second end of said tapered wall being connected to said bottom end;

a nozzle for dispensing liquid from said chamber when a compressing force is applied to said chamber, said nozzle formed in said bottom end of said chamber and having a longitudinal axis, said longitudinal axis of said nozzle being parallel to said longitudinal axis of said chamber when said nozzle is in a use position, said nozzle including a retractable spout means and a valve through which liquid is dispensed, said valve being closed when said spout means is retracted and being open when said spout means is extended;

said chamber further including a standing support, connected to said first end of said tapered wall and projecting away from said top end of said chamber along said lateral axis, for providing a planar surface for stability to said chamber when said chamber is standing on said bottom end, said support means surrounding at least a portion of said nozzle so that said nozzle is within a profile of said container formed by said chamber and said standing support, wherein said planar surface is opposed to a wall of said chamber; and a manually operable vent for permitting air to be drawn into said chamber after liquid has been dispensed, said vent being located in said top side of said chamber.

9. The container according to claim 8, wherein the manually operable vent includes an aperture in the chamber and a peel-back resealable cover for covering the aperture.

10. The container according to claim 8, the manually operable vent includes an aperture in the chamber and removable plug disposed within the aperture.

* * * * *